US012138733B2

(12) United States Patent
Mikhaylichenko et al.

(10) Patent No.: US 12,138,733 B2
(45) Date of Patent: Nov. 12, 2024

(54) ROLLER FOR LOCATION-SPECIFIC WAFER POLISHING

(71) Applicant: Applied Materials, Inc., Santa Clara, CA (US)

(72) Inventors: Ekaterina A. Mikhaylichenko, San Jose, CA (US); Fred C. Redeker, Fremont, CA (US); Brian J. Brown, Palo Alto, CA (US); Chirantha Rodrigo, Santa Clara, CA (US); Steven M. Zuniga, Soquel, CA (US); Jay Gurusamy, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 17/684,285

(22) Filed: Mar. 1, 2022

(65) Prior Publication Data

US 2022/0281062 A1 Sep. 8, 2022

Related U.S. Application Data

(60) Provisional application No. 63/157,610, filed on Mar. 5, 2021.

(51) Int. Cl.
*B24B 37/04* (2012.01)
*B24B 37/11* (2012.01)

(52) U.S. Cl.
CPC ..... *B24B 37/042* (2013.01); *B24B 37/11* (2013.01)

(58) Field of Classification Search
CPC ..... B24B 37/042; B24B 37/11; B24B 37/10; B24B 37/20; B24B 37/34; B24B 37/228; B24B 37/04; B24B 37/107; B24B 57/02; B24B 57/00; B24B 55/02
USPC ..... 451/178
See application file for complete search history.

(56) References Cited

U.S. PATENT DOCUMENTS

| | | | | |
|---|---|---|---|---|
| 5,707,274 | A | 1/1998 | Kim et al. | |
| 5,775,983 | A | 7/1998 | Norman et al. | |
| 5,827,115 | A | 10/1998 | Shimizu | |
| 6,150,271 | A | 11/2000 | Easter et al. | |
| 6,461,224 | B1 * | 10/2002 | Frost | H01L 21/67046 451/41 |

(Continued)

FOREIGN PATENT DOCUMENTS

| | | |
|---|---|---|
| CN | 101233221 | 7/2008 |
| JP | 2001-351884 | 12/2001 |

(Continued)

OTHER PUBLICATIONS

International Search Report and Written Opinion in International Appln. No. PCT/US2022/018360, dated Jun. 7, 2022, 12 pages.

(Continued)

*Primary Examiner* — David S Posigian
*Assistant Examiner* — Sukwoo James Chang
(74) *Attorney, Agent, or Firm* — Fish & Richardson P.C.

(57) ABSTRACT

A polishing apparatus includes a support configured to receive and hold a substrate in a plane, a polishing pad affixed to a cylindrical surface of a rotary drum, a first actuator to rotate the drum about a first axis parallel to the plane, a second actuator to bring the polishing pad on the rotary drum into contact with the substrate, and a port for dispensing a polishing liquid to an interface between the polishing pad and the substrate.

15 Claims, 6 Drawing Sheets

(56) References Cited

U.S. PATENT DOCUMENTS

| | | | | |
|---|---|---|---|---|
| 6,520,833 | B1 | 2/2003 | Saldana et al. | |
| 6,705,922 | B1 * | 3/2004 | Inbe | B24B 49/12 451/6 |
| 7,074,109 | B1 | 7/2006 | Bennett et al. | |
| 7,077,731 | B1 * | 7/2006 | Zhang | B08B 1/04 451/194 |
| 2002/0037649 | A1 * | 3/2002 | Shingu | H01L 21/31053 438/692 |
| 2002/0193051 | A1 | 12/2002 | Homma et al. | |
| 2003/0045206 | A1 | 3/2003 | Farrar | |
| 2004/0016507 | A1 | 1/2004 | Hu et al. | |
| 2016/0016282 | A1 | 1/2016 | Chen | |
| 2018/0301367 | A1 | 10/2018 | Yamaki et al. | |
| 2020/0238471 | A1 * | 7/2020 | Barkam | H01L 21/31053 |
| 2021/0066086 | A1 * | 3/2021 | Kim | C09G 1/02 |

FOREIGN PATENT DOCUMENTS

| | | |
|---|---|---|
| JP | 2005-342866 | 12/2005 |
| JP | 2007-118187 | 5/2007 |
| TW | 490362 | 6/2002 |

OTHER PUBLICATIONS

Office Action in Taiwanese Appln. No. 111107473, dated Oct. 31, 2022, 8pages (with English search report).
Notice of Allowance in Chinese Appln. No. 202210213861.2, dated Aug. 5, 2024, 10 pages (with English translation).
Wang et al., "Study on Temperature Control Technology of CMP Polish Table," Equipment for Electronic Products Manufacturing, Jun. 4, 2011, 10: 17 pages (with partial English translation).

* cited by examiner

ROLLER FOR LOCATION-SPECIFIC WAFER POLISHING

PRIORITY CLAIM

This application claims benefit from U.S. Provisional Patent Application No. 63/157,610, filed Mar. 5, 2021, which is hereby incorporated by reference.

TECHNICAL FIELD

The present disclosure relates to chemical mechanical polishing, and in particular to use of a roller to address polishing non-uniformity.

BACKGROUND

An integrated circuit is typically formed on a substrate (e.g. a semiconductor wafer) by the sequential deposition of conductive, semiconductive or insulative layers on a silicon wafer, and by the subsequent processing of the layers.

One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization may be used to planarize the substrate surface for lithography.

Chemical mechanical polishing (CMP) is one accepted method of planarization. This planarization method typically requires that the substrate be mounted on a carrier head. The exposed surface of the substrate is placed against a rotating polishing pad. The carrier head provides a controllable load on the substrate to push it against the polishing pad. A polishing liquid, such as slurry with abrasive particles, is supplied to the surface of the polishing pad during material removal.

SUMMARY

In one aspect, a polishing apparatus includes a support configured to receive and hold a substrate in a plane, a polishing pad affixed to a cylindrical surface of a rotary drum, a first actuator to rotate the drum about a first axis parallel to the plane, a second actuator to bring the polishing pad on the rotary drum into contact with the substrate, and a port for dispensing a polishing liquid to an interface between the polishing pad and the substrate.

In another aspect, a method of chemical mechanically polishing a substrate includes bringing a cylindrical polishing surface of a roller into contact with a front face of a substrate with a primary axis of the roller parallel to the polishing surface, supplying a polishing liquid to an interface between the polishing pad and the substrate, and causing relative motion between the roller and the substrate so as to polish an under-polished region of the substrate without removing material from at least some of the front face of the substrate. The relative motion includes at least rotating the roller about the primary axis while pressing the roller against the front face of the substrate.

In another aspect, a method of chemical mechanically polishing a substrate includes obtaining a thickness profile of a substrate, determining an angular asymmetry in polishing of the substrate from the thickness profile, bringing a cylindrical polishing surface of a roller into contact with a front face of a substrate with a primary axis of the roller parallel to the polishing surface, supplying a polishing liquid to a surface of the substrate, rotating the roller about the primary axis while pressing the roller against the front face of the substrate, and at least one of decreasing a rotation rate of the substrate, increasing a rotation rate of the roller, or increasing a pressure of the roller against the front face of the substrate as an underpolished region of the substrate passes below the roller so as to compensate for the angularly asymmetry.

In another aspect, a method of chemical mechanically polishing a substrate includes bringing a cylindrical polishing surface of a roller into contact with a front face of a substrate with a primary axis of the roller parallel to the polishing surface, supplying a polishing liquid to a surface of the substrate, and rotating the roller about the primary axis while pressing the roller against the front face of the substrate.

Advantages of implementations can include, but are not limited to, one or more of the following.

Using location-specific profile correction with a polishing roller, within-wafer non-uniformity (WIWNU) and wafer-to-wafer non-uniformity (WTWNU) can be reduced. Material removal can compensate for edge thickness non-uniformity induced following main CMP step and/or to correct incoming substrate film thickness profiles before undergoing primary polishing. The pressure applied to the polishing roller translates directly to the substrate surface rather than through wafer backside, increasing the location specificity and reducing substrate flex during location-specific polishing. The dimensions of the pressure zone are small and are controlled by the dimension of polishing roller, allowing material removal in highly specific areas.

The details of one or more embodiments are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Over the course of a CMP operation, the substrate thickness over the surface of the substrate can vary due to inconsistent polishing pad or carrier head pressure or dwell times or other inherent polishing non-uniformities. For example, some substrates are subject to a "check mark"

non-uniformity in which an annular region near but not at the edge of the substrate is under-polished. In addition, the substrate edge can be subject to asymmetry.

CMP customers impose stringent film thickness uniformity thresholds on deliverable substrates. Typical CMP processes often achieve these thresholds for the majority of the central surface area of a substrate. However, interactions between substrate edge, polishing pad, and head retaining ring lead to non-uniformities in the edge region, including the "check mark" features, which cannot be eliminated by pressure control of the head zones. Moreover, incoming substrates can include non-uniform film thickness profiles that are challenging or impossible to correct with existing head technology, such as a pre-existing large edge thickness profile.

Various "touch-up" polishing processes have been proposed, e.g., using a small rotating disk-shaped polishing pad. However, such "touch-up" polishing processes contact the substrate in a small region and thus have low throughput.

Described herein is a location-specific polishing method. The method can provide substrate edge thickness profile correction. Material removal is accomplished by a polishing roller, e.g., a polishing pad affixed to the outer surface of a cylindrical roller. The parameters of the polishing roller, e.g., roller diameter, pad grit, can be selected to correspond to the substrate shape and/or thickness profile achieving flexibility in the design. Additionally, the polishing roller can be purchased conventionally or 3D printed, thereby realizing cost savings and reducing device down-time for maintenance. The controller functions to optimize substrate rotational speeds, polishing roller rotational speeds, and roller scanning profile to accomplish precise, location-specific material removal.

Figure 1:
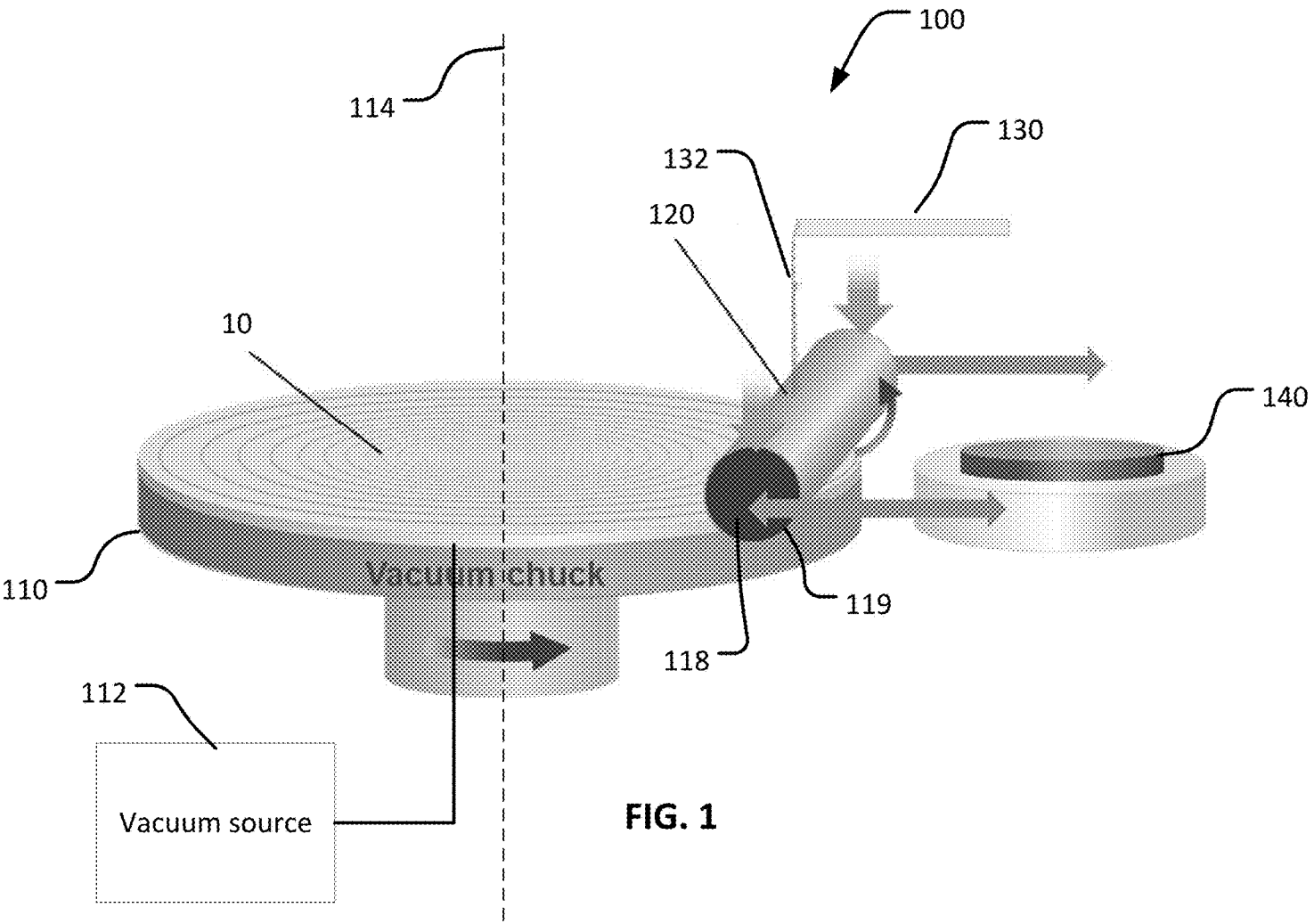
FIG. 1 is a perspective-view schematic diagram of the substrate polishing apparatus.

FIG. 1 illustrates an example chemical mechanical polishing apparatus 100 for polishing an under-polished region of a substrate. The polishing apparatus 100 includes a rotatable disk-shaped platen 110 on which a substrate 10 is situated. The platen 110 is operable to rotate about an axis 114, for example, a motor can turn a drive shaft to rotate the platen 110. The substrate 10 is held to the top surface of the platen 110, e.g., by a vacuum applied to the bottoms surface of the substrate 10 by a vacuum source 112, e.g., a vacuum chuck. The vacuum platen 110 maintains the substrate 10 orientation and position on the platen 110 while rotating about the axis 114. The vacuum platen 110 provides the entire top surface of the substrate 10 to the polishing apparatus 100 and does not impede the polishing process.

The polishing apparatus 100 includes a first actuator operable to rotate a rotary drum 118 about a primary axis. A polishing pad 119 is affixed to at least a portion of the cylindrical outer surface of drum 118, thus forming a cylindrical polishing surface. The drum 118 and affixed polishing pad 119 constitute a roller 120. The roller 120 polishing surface is composed of a material suitable for polishing and planarization of the substrate 10. The polishing pad material can be a polymer layer, e.g., polyurethane, and can be microporous layer, for example, an IC1000™ polishing layer material. The drum 118 of FIG. 1 is cylindrical with a length longer than a diameter. The primary axis of rotation is coaxial with the longitudinal axis of the roller 120. The roller 120 is arranged such that the primary axis is parallel with a front face, e.g., the upper surface, of the substrate 10.

The polishing apparatus 100 includes a second actuator to control the vertical position of the roller 120 with respect to the substrate 10 and platen 110. The second actuator operates to bring the roller 120 longitudinal surface into, and remove the roller 120 surface from, contact with the substrate 10 surface.

The polishing apparatus 100 includes a port 130 to dispense polishing liquid 132, such as an abrasive slurry, onto the roller 120. Alternatively, the port could dispense the polishing liquid directly onto the substrate 10 where it would be carried by rotation of the platen 110 below the roller 120.

The polishing apparatus 100 can also include a polishing pad conditioner 140, e.g., a diamond-embedded conditioner disk, to abrade the roller 120 surface to maintain the roller 120 in a consistent abrasive state. The pad conditioner 140 can be positioned adjacent the platen 110 in a face-up position generally coplanar with the top of the platen 110 or substrate 10.

Figure 2A:
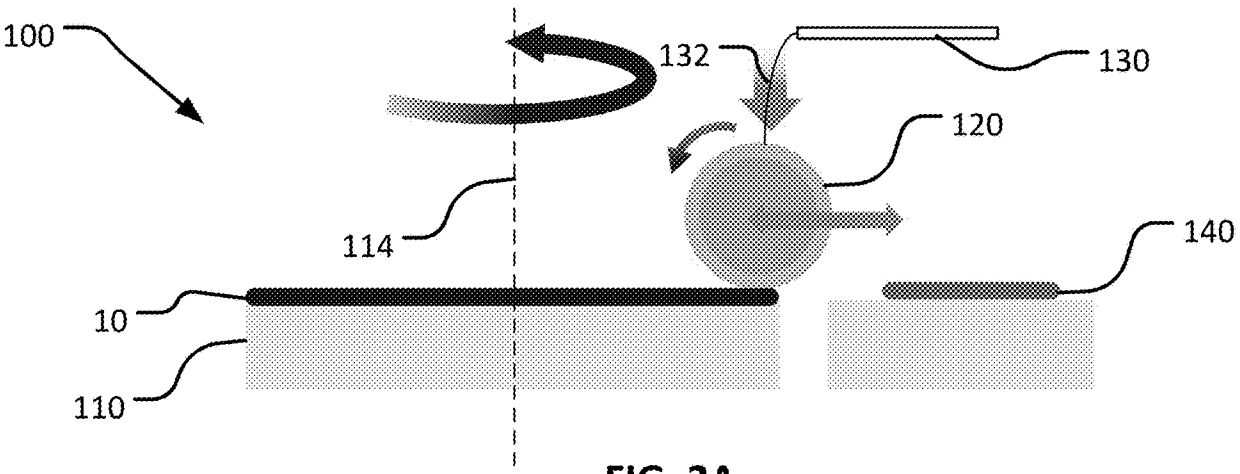
FIGS. 2A and 2B are side-view schematic diagrams of exemplary substrate polishing apparatus including one or two rotary polishing pads.
Figure 2B:
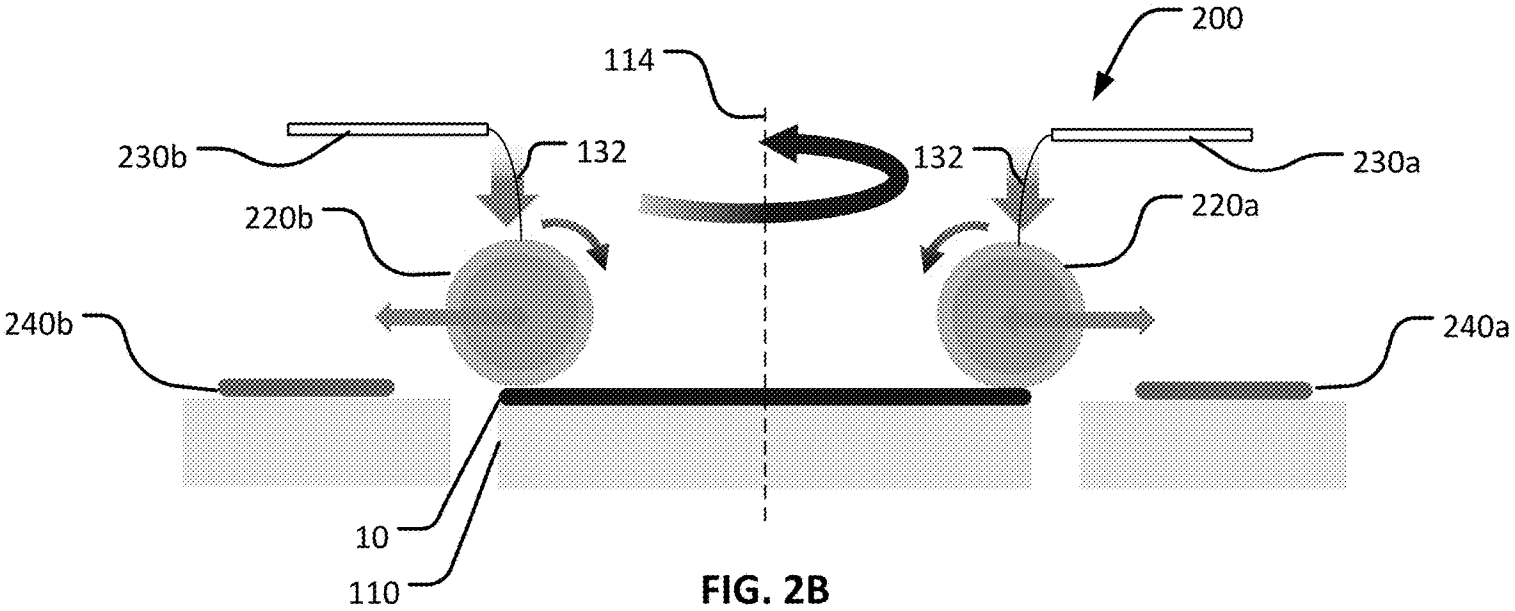

FIGS. 2A and 2B illustrate the operation of the polishing apparatus 100 utilizing one roller 120 and two rollers 220, e.g., roller 220*a* and roller 220*b*, respectively. Referring to FIG. 2A, the platen 110 supporting the substrate 10 rotates about axis 114. The roller 120 is caused to rotate about the primary axis, such as by a second motor controlling the rotational motion of the roller 120. The primary axis in the side-view of FIG. 2A extends into the page.

The polishing liquid 132 is supplied to the roller 120 polishing surface via port 130, as shown in FIG. 1. In some embodiments, the polishing liquid 132 is supplied to the substrate 10 surface via port 130. The roller 120 primary axis can be oriented at any angle in a range from 0° (e.g., parallel with) to 90° (e.g., perpendicular to) with respect to a ray (e.g., segment) connecting the substrate 10 centerpoint to the roller 120 centerpoint. For example, the roller 120 primary axis of FIG. 1 is oriented perpendicular to (e.g., at 90° from) a ray connecting the substrate 10 centerpoint to the roller 120 centerpoint.

Figure 5A:
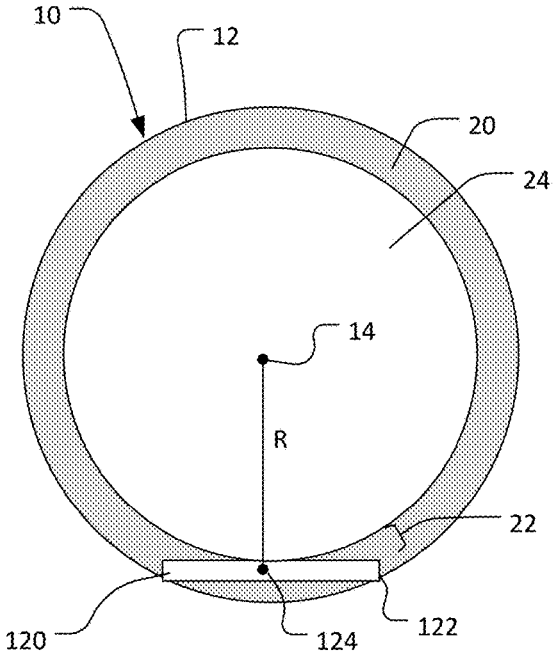
FIGS. 5A and 5B are schematic top views of the substrate polishing apparatus.

Referring to FIG. 5A, as a region of the top surface near the substrate edge can often be underpolished, an implementation that can be of particular use is one in which the edges 122 of the roller 120 are positioned at or near, e.g., within 2 mm, of the edge 12 of the substrate 10. In addition, the roller 120 is substantially perpendicular to (e.g., 80-90 from) the ray R connecting the substrate centerpoint 14 to the roller centerpoint 124. In this configuration, the polishing action is concentrated at an annular region 20 of the top surface of the substrate 10 adjacent the substrate edge 12, with higher polishing rate in a region 22 that is spaced apart from the substrate edge. A central region 24 radially inward of the annular region 20 is not polished. This configuration can be particularly well suited for compensating for the checkmark region. It should be noted that the polishing here occurs on the general planar surface of the substrate.

Figure 5B:
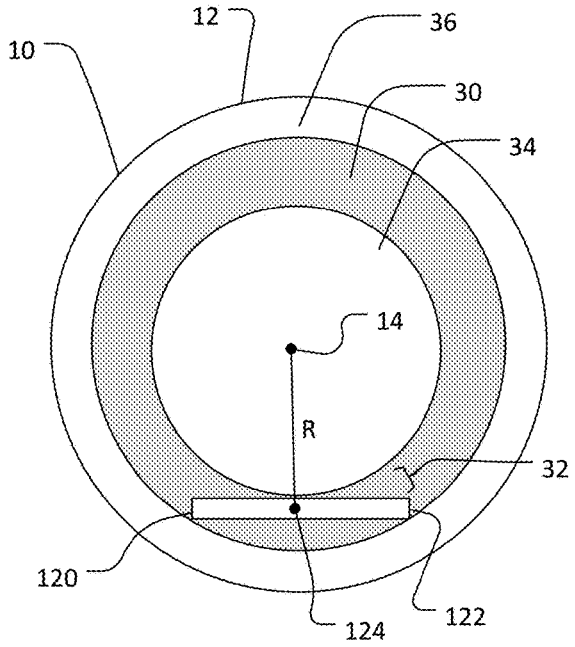

Alternatively, as shown in FIG. 5B, the edges 122 of the roller 120 can be positioned radially inward, e.g., by 1-30 mm, from the edge 12 of the substrate 10. Again, the roller 120 is substantially perpendicular to (e.g., 80-90° from) the ray R connecting the substrate centerpoint 14 to the roller centerpoint 124. In this configuration, the polishing action is concentrated at an annular region 30 of the top surface of the substrate 10 that is spaced apart from the substrate edge 12. There may be a higher polishing rate in a region 32 that is closer to the inner diameter of the annular region 30. A central region 34 radially inward of the annular region 30 and a second annular region 36 surrounding the polished annular region 30 are not polished. This configuration can also be well suited for compensating for the checkmark region.

Returning to FIG. 1, the roller 120 is brought into contact with the front face of the substrate 10 creating a contact area between the roller 120 polishing surface and the substrate 10 front face. The polishing apparatus 100 commands the second actuator to apply a force to the roller 120, e.g., pressed, in a direction orthogonal to and toward the substrate 10, e.g., down in FIG. 2A. The force applied to the contact area via roller 120 can be in a range from 30 psi to 70 psi (e.g., 40 psi to 50 psi, or 60 psi to 70 psi).

The rotational motion of the roller 120 polishing surface in the presence of the polishing liquid 132 causes a portion of the substrate 10 material in the contact area to be removed, e.g., polished, while not removing substrate 10 material outside of the contact area. If necessary, the roller 120 can be moved along an axis parallel to the plane of the substrate 10, e.g., right to left in FIG. 2A, to reposition the contact area along the substrate 10 front face. The substrate 10 rotation and roller 120 rotational and translational motion create a relative motion between the roller 120 and the substrate 10 front face. While in contact with the substrate 10 the roller 120 rotational speed can be in a range from 10 rpm to 2500 rpm (e.g., 50 rpm to 1500 rpm).

The time period in which the roller 120 polishing surface is in contact with the substrate 10 is a contact time. The dwell time of the roller over any particular region, in conjunction with the pressure and rotation rates, determine the amount of material removed from the substrate. After the contact time between the roller 120 and the substrate 10, the roller 120 polishing surface, the roller 120 can be removed from the substrate 10 to stop polishing. The contact time can be in a range from less than 1 s to 600 s.

After a polishing operation is complete, the polishing surface can be reconditioned by removing the roller 120 from the substrate 10 front face and contacting the roller 120 polishing surface to the pad conditioner 140. For example, the second actuator can move the roller horizontally from a position over the substrate to a position over the pad conditioner 140. The polishing apparatus 100 causes roller 120 rotational motion while in contact with the pad conditioner 140 thereby abrading an outer layer of the roller 120 polishing surface. The roller 120 remains in contact with the pad conditioner 140 while continuing to rotate for a conditioning time. In some embodiments, additional relative motion between the roller 120 and pad conditioner 140 can include translating the roller 120 along an axis parallel with the pad conditioner 140 surface.

FIG. 2B illustrates another implementation of a polishing apparatus 200 that includes roller 220*a* and roller 220*b* (collectively rollers 220), to polish the substrate 10. The substrate 10 rotates about axis 114 on the platen 110. Two ports, 230*a* and 230*b*, (collectively ports 230) are positioned adjacent rollers 220*a* and 220*b*, respectively, supplying polishing liquid 132 to each. In such embodiments, the rollers 220 can be substantially the same, or different, including length, diameter, compressibility, elasticity, and material composition of the polishing surface. For example, the polishing surface of roller 220*a* may have a first durometer value, and the polishing surface of roller 220*b* may have a different second durometer value.

Rollers 220*a* and 220*b* (collectively rollers 220) can create substantially the same, or different, relative motion between the substrate 10 and the respective rollers 220*a* and 220*b*, including respective rotational- and/or translational speeds, translational axis-, and/or primary axis-orientation.

The polishing apparatus 200 includes two pad conditioners 240, pad conditioner 240*a* and 240*b* respectively. The pad conditioners 240 can be substantially the same material, or different, and include substantially the same abrasive capability (e.g., grit), or different. For example, the conditioning surface of roller pad conditioner 240*a* may have a first durometer value, and conditioning surface of roller pad conditioner 240*b* may have a different second durometer value. The rollers 220 can be operated to contact the pad conditioners 240 concurrently or differentially.

Embodiments including two or more rollers 220 can reduce substrate 10 polishing time, thereby decreasing material and time costs associated with substrate 10 polishing.

Figure 3:
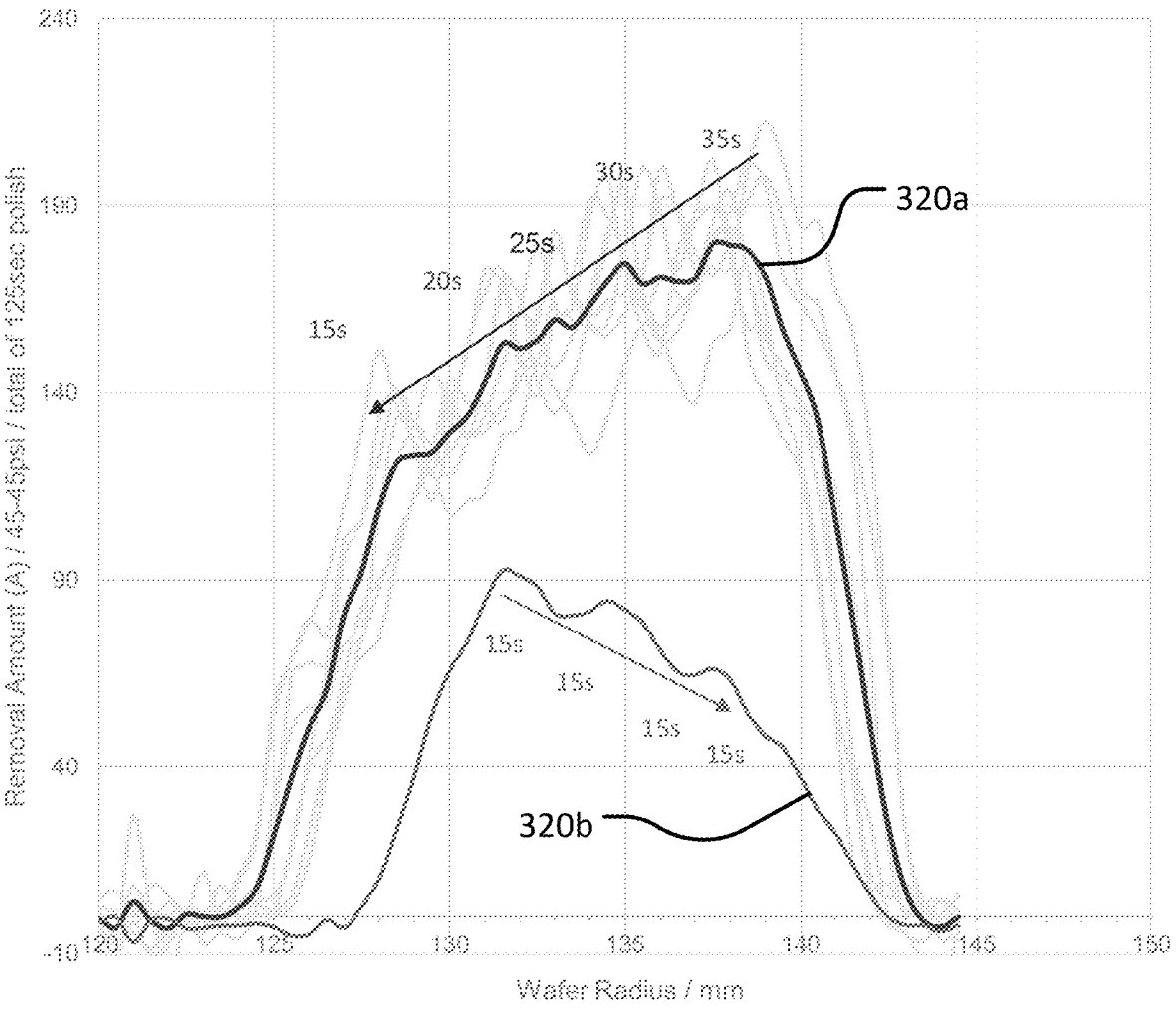
FIG. 3 is a chart depicting example edge thickness profiles.

The contact time, roller 120 rotational- and translational speed, and pressure parameters can be determined based upon the amount of material removed to achieve thickness profile limits and compose a correction profile. The correction profile can be loaded into a controller of the polishing apparatus 100 to control the platen 110, roller 120, and 132 flow rate. FIG. 3 is a chart comparing the material removed from the surface of the substrate 10 on the y-axis to wafer radial location on the x-axis. The y-axis depicts a range of material removed from 0 Angstroms (Å) to 240 Å. A higher y-axis value indicates that more material was removed from the substrate 10 surface at the corresponding x-axis radial location. The x-axis includes radial locations in a range from 120 mm to 150 mm. FIG. 3 includes lines depicting two surface profiles, the first surface profile 320*a* and second surface profile 320*b*, which extend from 120 mm to 145 mm on the x-axis.

Surface profile 320*a* is a calculated average profile of eight measured surface profiles as measured along eight lines extending radially from the center of the substrate 10 from 120 mm to 145 mm, wherein the eight lines are oriented with even radial spacing around the circumference of the substrate 10.

The polishing apparatus 100 was operated to polish the substrate 10 according to two correction profiles. The first correction profile corresponding to surface profile 320*a* included a pressure parameter of 45 psi, and the roller 120 was positioned at five radial locations for five respective time periods totaling 125 seconds of dwell time. The initial roller 120 location was approximately 137 mm, the second location approximately 135 mm, the third location approximately 133 mm, the fourth location approximately 131 mm, and the fifth location approximately 128 mm along a radial ray from the substrate 10 center.

The roller 120 had dwell times of 35 s, a 30, 25 s, 20 s, and 15 s at the first, second, third, fourth, and fifth radial locations, respectively. Thereafter the roller 120 was removed from contact with the substrate 10. This creates a sloped surface profile 320*a* in which the roller 120 removed a larger amount of material at the outermost radial location (137 mm) and removed consecutively less material at successively inwardly positioned radial locations.

The second correction profile corresponding to surface profile 320*b* included a pressure parameter of 45 psi, and the roller 120 was positioned at four radial locations a radial line for four 15 s time periods totaling 60 s of dwell time. The initial roller 120 location was approximately 131 mm, the second location approximately 133 mm, the third location approximately 136 mm, and the fourth location approximately 139 mm along a radial ray from the substrate 10 center.

The roller 120 had dwell times of 15 s at each radial location, respectively, and thereafter the roller 120 removed from contact with the substrate 10. This creates a sloped surface profile 320*b* wherein the roller 120 removed a smaller amount of material at the outermost radial location (137 mm) and removed consecutively more material at successively inwardly positioned radial locations.

Figure 4:
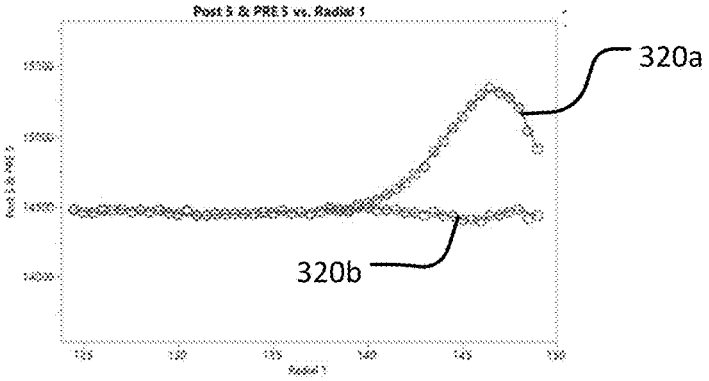
FIG. 4 is a chart depicting a first edge thickness profile before treatment and a second edge thickness profile following treatment.

FIG. 4 is a is a chart comparing substrate 10 surface height in Angstroms as measured along a line extending as a ray from the substrate 10 centerpoint on the y-axis to radial location in mm on the x-axis. FIG. 4 includes two edge profiles, 420*a* and 420*b*. Edge profile 420*a* corresponds with a substrate 10 surface before the polishing apparatus 100 polishes the surface using a correction profile. Edge profile 420*a* is approximately planar at 14,500 Å between 125 mm and 135 mm on the x-axis. Between 135 mm and 150 mm, the measured substrate 10 surface corresponds to an increasing surface height to an approximate 15,300 Å height before reducing to a value of approximately 14,900 Å at 149 mm on the x-axis.

Edge profile 420*b* depicts the substrate 10 surface after the polishing apparatus 100 polished the substrate 10 according to a correction profile in which the parameters were designed to correct the edge profile 420*a* to an approximately planar substrate 10 surface. The polishing apparatus 100 achieved an approximately planar substrate 10 surface along the measured surface, as shown in edge profile 420*b*.

In some embodiments, the polishing apparatus 100 includes an in-situ monitoring system to monitor one or more thicknesses of the substrate. Examples of in-situ monitoring systems include optical monitoring, e.g., spectrographic monitoring, eddy current monitoring, acoustic monitoring, and motor torque monitoring. The in-situ monitoring system determines a thickness, such as a thickness relative to the edge 12 or relative to central region 24, at one or more radial positions within an annular region, such as annular region 20 or annular region 30. The polishing apparatus 100 controller constructs a thickness profile from the one or more thicknesses. In some embodiments, a thickness profile can be determined using an in-line metrology system. Examples of in-line monitoring systems include optical monitoring, e.g., a color imager, spectrographic sensor, or ellipsometer, or an eddy current sensor.

For example, a first thickness profile can be determined from an annular region 20 on the substrate 10 surface. An annular region 20 in which the outer radius is aligned with the substrate edge 12 produces an edge-thickness profile. The polishing apparatus 100 contacts the annular region 20 with roller 120 and polishes the annular region 20 for a time interval.

The polishing apparatus 100 determines a second thickness profile using the in-situ monitoring system of the annular region 20 (e.g., a second edge-thickness profile). The polishing apparatus 100 compares the first edge-thickness profile to the second edge-thickness profile to determine an edge-thickness difference. In some embodiments, the first and second edge-thickness profiles are compared and the edge-thickness difference determined during the polishing. When the edge-thickness difference is below a threshold stored in the polishing apparatus 100, the polishing apparatus 100 causes the second actuator to bring the polishing pad out of contact with the chart comparing substrate 10.

The roller 120 can be constructed to conform to different shape profiles. The examples described above include a horizontally-oriented cylindrical roller 120 though in some embodiments, the roller 120 can be wheel-shaped, in which the radius is larger than the length of the roller 120. Such embodiments provide a lower roller 620 contact surface with the substrate 60 and increase the polishing spatial resolution.

Figure 6A:
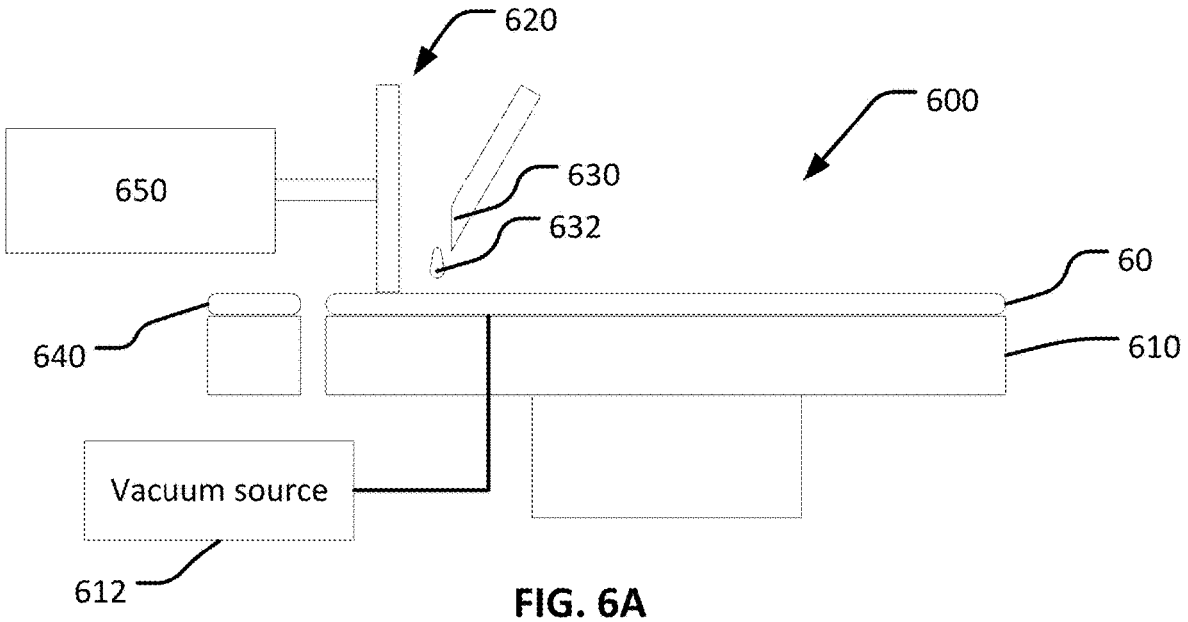
FIGS. 6A through 6C are schematic views of a substrate polishing apparatus including a wheel-shaped polishing pad.

FIG. 6A shows an example polishing apparatus 600 including a wheel-shaped roller 620 coupled to a motor 650. The roller 620 is in contact with the substrate 60 arranged on a platen 610 including a vacuum source 612 to maintain the position and orientation of the substrate 60 on the platen 610 during polishing. The polishing apparatus 600 dispenses polishing liquid 632 onto the substrate 60 surface via port 630 and operates the motor 650 causing rotational motion in the roller 620 when in contact with the substrate 60. The polishing apparatus 600 includes pad conditioner 640 to abrade and re-condition the roller 620. As in FIG. 2B, the polishing apparatus 600 can include more than one roller 620, and/or more than one pad conditioner 640 for each respective roller 620.

The platen 610 rotates around a first vertical central axis and the roller 620 rotates about a second axis perpendicular to the first, and parallel with the substrate 60 surface. In some embodiments, the motor 650 can translate the roller 620 along the second axis to cause relative motion between the substrate 60 and roller 620 in a third dimension, which can be in addition or alternative to the motion along the first and second rotational axes.

Figure 6B:
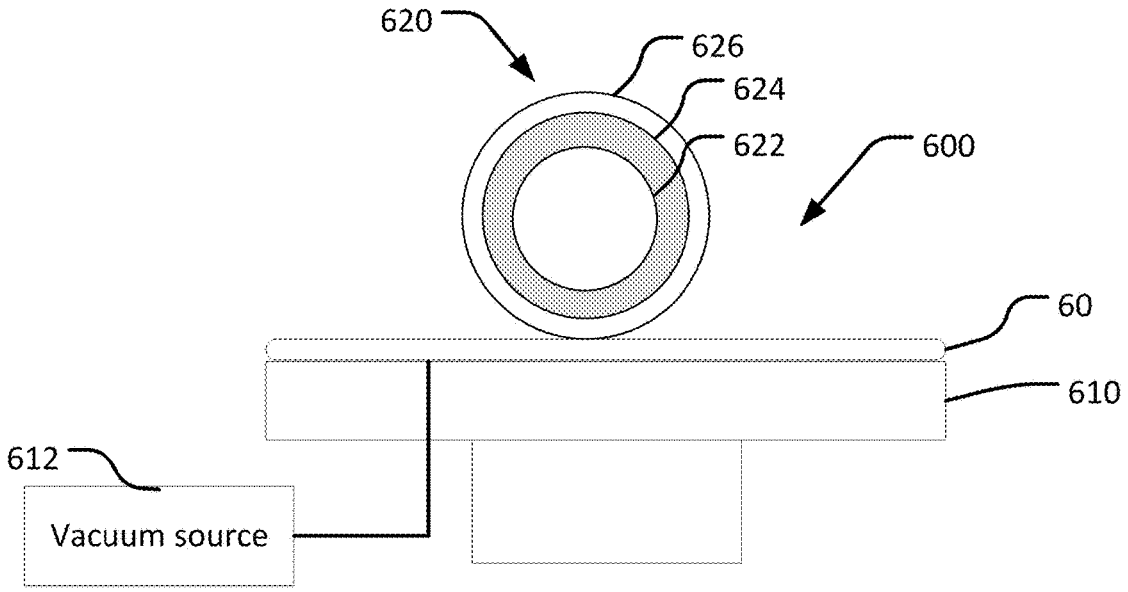

FIG. 6B depicts a side view along the roller 620 second rotational axis, e.g., in-line with the motor 650 rotational axis. The roller 620 includes a rigid central drum 622 around which an inflatable support tube 624 encompasses. The support tube 624 provides at least a portion of the pressure applied to the pad 626 when in contact with the substrate 60. In some embodiments, the support tube 624 is inflated to a pressure in a range from 1 psi to 50 psi. In various example embodiments, the support tube 624 inflation pressure is a parameter controlled by the polishing apparatus 600 in a correction profile to achieve an edge profile, such as planar edge profile 420*b*.

Figure 6C:
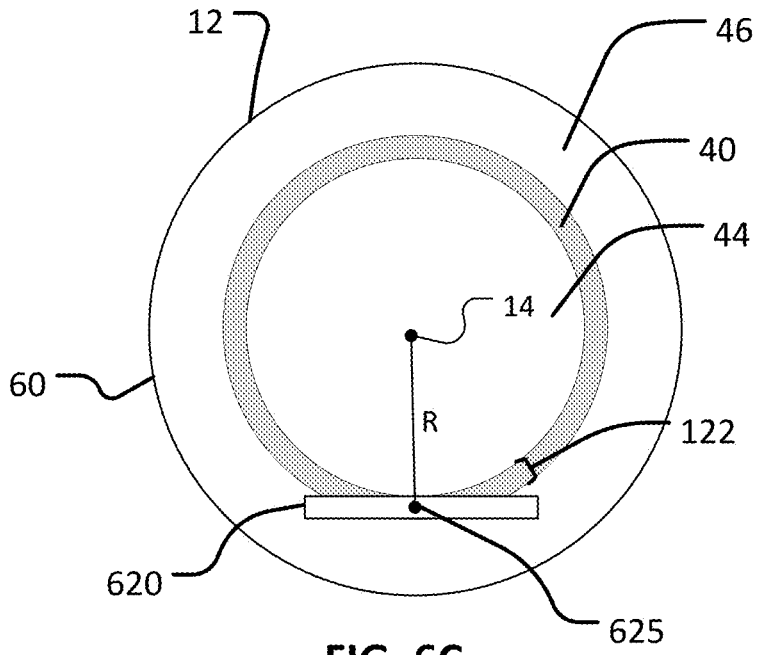

Referring to FIG. 6C, a top view of the implementation of FIGS. 6A and 6B is shown. Such implementations can be of particular use for increasing the polishing spatial resolution by decreasing the contact area of the roller 620. The roller 620 is substantially perpendicular to (e.g., 80 to 90° from) the ray R connecting the substrate centerpoint 14 to the roller centerpoint 625.

While the rollers 120 of FIGS. 5A and 5B were cylindrical and oriented such that the length was parallel with the substrate 10 surface, achieving a high surface area contact area, roller 620 is a wheel oriented perpendicular to the substrate 10 surface resulting in a low surface area contact area. In this configuration, the polishing action is concentrated at an annular region 40 of the top surface of the substrate 10 with a low radial width. A central region 44 radially inward of the annular region 40 is not polished.

While this specification contains many specific implementation details, these should not be construed as limitations on the scope of any invention or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially be claimed as such, one or more features from a claimed combination can in some cases be excised from the combination, and the claimed combination may be directed to a subcombination or variation of a subcombination.

Similarly, while operations are depicted in the drawings and recited in the claims in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

What is claimed is:

1. A polishing apparatus, comprising:

a platen configured to receive and hold a substrate in a plane;

a polishing pad affixed to a cylindrical surface of a rotary drum;

a first actuator to rotate the rotary drum about a first axis parallel to the plane;

a second actuator to bring the polishing pad on the rotary drum into contact with only an annular region adjacent an edge of the substrate;

a port for dispensing a polishing liquid to an interface between the polishing pad and the substrate;

an in-situ monitoring system to monitor a thickness of the substrate in the annular region and generate two or more edge-thickness profiles of the annular region; and a controller configured to;

compare a first edge-thickness profile to a second edge-thickness profile to determine an edge-thickness difference, cause the platen to rotate such that the substrate rotates about an axis perpendicular to the plane and aligned with a centerpoint of the substrate;

cause the second actuator to bring the polishing pad into contact with the annular region of a front face of the substrate by adjusting a position of a centerpoint of the rotary drum only along a segment extending from the axis to the centerpoint of the rotary drum wherein the first axis of the rotary drum is parallel to the polishing pad and wherein ends of the polishing pad are spaced radially inward of an edge of the substrate;

cause the port to supply the polishing liquid; and cause the first actuator to generate relative motion between the polishing pad and the substrate so as to polish an under-polished region of the annular region of the substrate without removing material from at least some of the front face of the substrate outside of the annular region, the relative motion including at least rotating the rotary drum about the first axis while pressing the rotary drum against the annular region of the front face of the substrate, and cause the second actuator to bring the polishing pad out of contact with the annular region when the edge-thickness difference is below a threshold.

2. The apparatus of claim 1, wherein the platen is rotatable about a second axis.

3. The apparatus of claim 1, wherein the rotary drum has a length greater than its diameter.

4. The apparatus of claim 1, wherein the rotary drum has a length less than its diameter.

5. A method of chemical mechanically polishing a substrate, comprising:

rotating a substrate about an axis perpendicular to a plane of the substrate and aligned with a centerpoint of the substrate;

bringing a cylindrical polishing surface of a roller into contact with an annular region of a front face of a substrate by adjusting a position of a centerpoint of the roller only along a segment extending from the axis to the centerpoint of the roller wherein a primary axis of the roller is parallel to the cylindrical polishing surface and wherein ends of the cylindrical polishing surface are spaced radially inward of an edge of the substrate;

supplying a polishing liquid to an interface between a polishing pad and the substrate; and causing relative motion between the cylindrical polishing surface and the substrate so as to polish an under-polished region of the annular region of the substrate without removing material from at least some of the front face of the substrate outside of the annular region, the relative motion including at least rotating the roller about the primary axis while pressing the roller against the annular region of the front face of the substrate.

6. The method of claim 5, wherein the cylindrical polishing surface extends across an edge of the substrate.

7. The method of claim 5, wherein opposing ends of the cylindrical polishing surface are positioned within 40 mm of the edge of the substrate.

8. The method of claim 7, comprising rotating the substrate about the axis at a rate of 1 to 500 rpm.

9. The method of claim 5, comprising rotating the cylindrical polishing surface about the primary axis at a rate of 50 to 1500 rpm.

10. The method of claim 5, comprising pressing the cylindrical polishing surface into contact with the substrate with a pressure of 30 psi to 70 psi.

11. A method of chemical mechanically polishing a substrate, comprising:

obtaining a thickness profile of an annular region adjacent an edge of a substrate;

determining an angular asymmetry in polishing of the substrate from the thickness profile;

rotating a substrate about an axis perpendicular to a plane of the substrate and aligned with a centerpoint of the substrate bringing a cylindrical polishing surface of a roller into contact with only the annular region on a front face of the substrate with a primary axis of the roller parallel to the cylindrical polishing surface by adjusting a position of a centerpoint of the roller only along a segment extending from the axis to the centerpoint of the roller;

supplying a polishing liquid to a surface of the substrate;

rotating the roller about the primary axis while pressing the roller against the front face of the substrate; and at least one of decreasing a rotation rate of the substrate, increasing a rotation rate of the roller, or increasing a pressure of the roller against the annular region on the front face of the substrate as an underpolished region of the annular region passes below the roller so as to compensate for the angular asymmetry.

12. The method of claim 11, comprising obtaining the thickness profile from an in-line metrology system in a chemical mechanical polishing system.

13. The method of claim 12, wherein the in-line metrology system includes a color imager, spectrographic sensor, ellipsometer, or eddy current sensor.

14. The method of claim 11, comprising moving the roller through a sequence of different positions within the annular region for a sequence of dwell times.

15. The method of claim 14, wherein at least two dwell times of the sequence of dwell times are different at different respective positions.

* * * * *